United States Patent [19]

Emery

[11] 4,088,855

[45] May 9, 1978

[54] KEYBOARD ELECTRO-MECHANICAL SWITCH WITH COIL SPRING CONTACT

[75] Inventor: William Boyd Emery, Kirkland, Wash.

[73] Assignee: Korry Manufacturing Co., Seattle, Wash.

[21] Appl. No.: 772,916

[22] Filed: Feb. 28, 1977

[51] Int. Cl.[2] ..... H01H 13/52; H01H 1/06

[52] U.S. Cl. ..... 200/16 A; 200/5 A; 200/159 R; 200/276; 200/302; 200/314

[58] Field of Search ..... 200/5 R, 16 A, 61.19, 200/61.76, 159 R, 276, 314, 302, 5 A

[56] References Cited

U.S. PATENT DOCUMENTS

| | | | |
|---|---|---|---|
| 959,435 | 5/1910 | Thomson | 200/159 R |
| 3,206,561 | 9/1965 | Fordeck | 200/5 R |
| 3,626,171 | 12/1971 | Abramowitz et al. | 200/314 X |
| 3,663,780 | 5/1972 | Golbeck | 200/314 |
| 3,697,706 | 10/1972 | Huggard | 200/61.19 X |
| 3,732,387 | 5/1973 | Berry | 200/276 X |
| 3,735,058 | 5/1973 | Berry | 200/61.76 X |
| 3,927,284 | 12/1975 | Andersson | 200/5 R |
| 4,002,873 | 1/1977 | Lewandowski | 200/314 |
| 4,017,700 | 4/1977 | West | 200/314 |

*Primary Examiner*—James R. Scott

*Attorney, Agent, or Firm*—Christensen, O'Connor, Johnson & Kindness

[57] ABSTRACT

A low-resistance electro-mechanical switch with snap-action tactile feel is disclosed comprising a base carrying one contact, a stepped guide post projecting from the base and carrying an opposing contact, and a conductive ring-like helical spring looped under tension around the guide post and serving as the bridging contactor. Instant complete switching is achieved with a snap action by advancing the spring against and abruptly past the step on the post, switching transients accompanying such snap action being avoided by the redundancy parallel paths that the several spring coils afford while settling in bridging position between the switch contacts.

14 Claims, 7 Drawing Figures

KEYBOARD ELECTRO-MECHANICAL SWITCH WITH COIL SPRING CONTACT

BACKGROUND OF THE INVENTION

This invention relates to improved reliably low-resistance electro-mechanical switches and more particularly to snap action, chatter-free switches of compact, durable, low-cost construction adapted for direct incorporation in or as a part of printed circuit devices or in other installations. The invention is herein illustratively described by reference to the presently preferred embodiments thereof; however, it will be recognized that certain modifications and changes therein with respect to details may be made without departing from the essential features involved.

In order to achieve positive instantaneous low-resistance steady state switching action in a snap-action switch it is desirable not only that the switch contactor snap abruptly into and from switch-actuated position but that the contact engagement that it makes remain electrically stable and of low electrical resistance from the instant of such engagement forward. However, the very abruptness of contactor movement in closing or actuating such switches can introduce circuit noise and electrical transient effects due to the bounce or chatter of the mechanical part as in changes positions. It is a broad object of this invention to overcome this difficulty and more particularly to do so in a switch of simple, compact form and one that affords a positive snap-action tactile sensation when actuated.

A further object hereof is to provide such a switch of low-cost construction having unusually low electrical resistance achieved upon and after the instant of actuation and achieved despite mechanical transients in the moveable contactor of the switch.

Berry, U.S. Pat No. 3,735,058 dated May 22, 1973, discloses a toroidal spring contactor type switch in some respects resembling the present invention but lacking the important essentials of the same. In that prior art device an objective is to avoid snap action in closing the switch contacts, and the longitudinal discontinuity in the guide post surface is to satisfy a switch-open detent requirement.

SUMMARY OF THE INVENTION

In accordance with this invention a conductive helically wound coil spring with ends joined together serves as the switch contactor. The spring, looped under tension around a post that serves both as one switch contact and as a guide for the spring in its switch operating movements, is advanced axially of the post by a manual actuator (e.g., push-button) into simultaneous bridging engagement with the post and a second contact carried on the switch base adjacent one end of the post. Approaching completion of its switch-actuation stroke, the spring must be forced past a step located on the post at a distance spaced from the base contact by less than substantially the radius of the spring coils. In the process of moving past the step, resistance to advancement of the spring remains high until the spring is wedged over the step in the post, whereupon it abruptly drops off to a relatively low level. This abrupt drop in resistance accompanied by continued application of actuation pressure axially of the post caused completion of the switching stroke to occur in a snap action that is readily sensed by the operator and that produces an abrupt closure of the switch contacts.

As an important feature of the switch, the electrical path between contacts extends through a multiplicity of coils of the contactor spring simultaneously engageable with such contacts. Thus localized contact contamination or irregularities do not impair the reliably low electrical resistance of the switch. Moreover, the parallel circuit path redundancy thus afforded not only provides extremely low steady-state switch resistance but assures that even though there may be mechanical transient undulations in the spring upon and after the instant of contact engagement, nevertheless, the associated electrical circuit will not be disturbed by these since there will be a number of coils at all times simultaneously bridging between the contacts. Furthermore, the wiping effect across the contact surfaces attending the snap-action modulations of the spring contactor further improve consistency in the low contact resistance of the switch.

Preferably the post contact is of tapered frusto-conical configuration, particularly over the portion of its length above the step, and is operably associated with a single base conductor completely surrounding the same so as to cooperate with all coils of the spring to achieve the maximum benefits thereof. However, it should be understood that the form of the post may vary and that more than one base contact may be employed, each associated with a plurality of contactor spring coils for simultaneous switching thereof with the post as the common contact. These and other aspects of the invention will become more fully evident from the following description by reference to the accompanying drawings.

DETAILED DESCRIPTION WITH REFERENCE TO DRAWINGS

Figure 3:
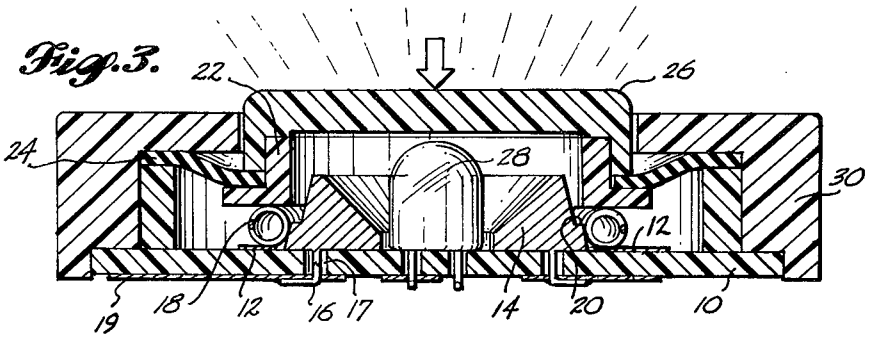
FIG. 3 is an elevational view in partial cross-section of the switch in the switch-closed position.
Figure 4:
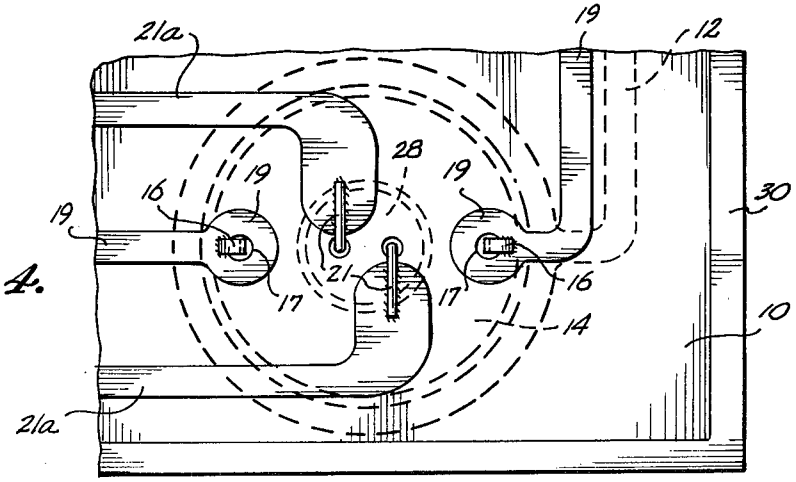
FIG. 4 is a bottom view of the switch assembly mounted on and as part of a printed circuit device.

In the drawings printed circuit board panel 10 of insulating material serves as the switch base. A switch contact of annular form, 12, is deposited on one face of the circuit board, with a lead conductor 12*a* extending therefrom to the marginal edge of the board for connection to an external circuit lead. An outwardly tapered post 14 of frusto-conical hollow configuration is mounted on the same face of the circuit board 10 and centrally within the annular contact conductor 12. Of slightly smaller base diameter than the inside diameter of the annular conductor 12 the post itself is of conductive material, at least the external surface thereof adjacent to the circuit board is conductive, so that the post 14 may serve as the opposing or second switch contact cooperating with the ring contact 12. The post 14 is securely mounted on the board by means of tabs or prongs 16 projecting through apertures 17 in the panel 10 and turned over on the opposite face thereof as best shown in FIGS. 3 and 4. Preferably the bent ends of the tabs 16 are soldered to one or more conductive leads 19 on the reverse face of the board 10. In its illustrated application the hollow interior of the switch post 14 accomodates an electrical lamp 28 the lead terminals 21 of which extend through apertures in the panel and are soldered in contact with the conductive leads 21*a* on the reverse side of the board.

Figure 2:
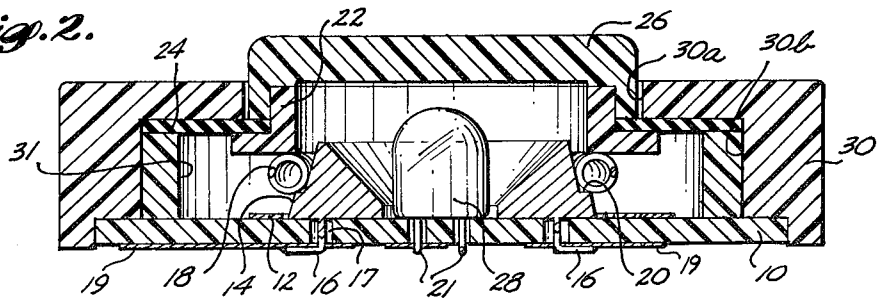
FIG. 2 is an elevational view in partial cross-section of the switch in the switch-open position.

Surrounding the central post contact 14 is a helical spring 18 of conductive material such as berilium-copper alloy the ends of which are joined together to form a loop nominally of toroidal form. Spaced a distance less than substantially the radius of the coils of spring 18 above the base conductor 12 is a step 20 in the exterior wall of the post 14. Normally, in the switch-open position of the spring 18 serving as the switch contactor, the spring, while still under contactile tension, lies retracted above the step 20 as depicted in FIG. 2. The width of the step radially of the post 14 is preferably slightly less than half the radius of the spring coils so as to present a substantial but readily surmountable resistance to downward sliding movement of the spring past the step into engagement with the contact ring 12 when the switch is actuated. The relaxed length of the spring in relation to the girth of the post is such that the spring is maintained under some tension in its retracted or elevated position, wherein it is most contracted, as depicted in FIG. 2. Such tension, of course, increase as the spring is pressed downwardly over the widening post toward its base. Taper of the exterior surface of the post accompanied by contractive force in the spring makes the spring self retracting and the spring thereby self-opening upon release of the spring. This results from the component of force in the axial direction inherent in the resolution of the radially directed force of contact of the spring on the inclined post surface. If the step is spaced from the base by materially less than the spring coil radius, then taper of the post beneath the step is not necessary to initiate spring retraction movement when the push-button cap is released.

In order to house the switch, panel 10 is set into a recess in the base of the housing block 30. The latter has a central round aperture 30*a* in its outer wall leading into a wider annular recess 30*b* capable of accomodating the switch parts. A flexible rubber annular diaphragm 24 is clamped by its outer periphery between the upper inside corner shoulder of the recess 30*b* and the underlying retainer ring 31 that seats against the inside face of the base panel 10. A flanged ring 22 that bears axially against the contact spring 18 is bonded inside a transluscent push-button cap 26 and, with the cap, forms a groove that snugly receives the inside peripheral edge of the rubber ring 24 to form a seal therewith as shown. Thus the rubber ring 24 serves as a vapor and moisture seal for the switch. It also serves as a floating centering support for the translucent cap 26 and its associated switch actuator ring 22 that permits switch actuation movement of the latter inwardly and outwardly of the housing by the application and removal of thumb pressure on the push-button 28. The spring contactor record force is sufficient to urge the push-button normally to its retracted outermost position.

It will be appreciated that the electrical conductors 21*a* associated with the leads 21 of the lamp 28 are not necessarily directly associated electrically with the switch contacts 14, 12. Indeed in a principal application for which the present embodiment of the switch mechanism was designed, namely verification circuits for computer system, the switching function effected by bridging of the contactor-spring 18 between the contacts 14 and 12 performs a circuit probing or interrogating function directed toward a portion of a computer system, with separate circuitry in the latter responding appropriately to verify the operativeness or readiness of that portion of the system and signalling such readiness back through separate leads to the lamp 28.

Figure 5:
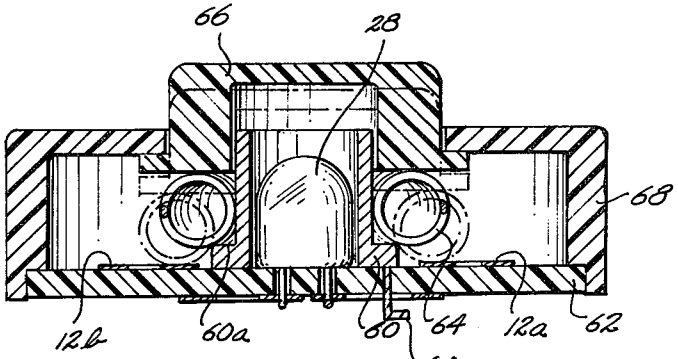
FIG. 5 is an elevational view largely in cross-section of another embodiment of the invention.
Figure 6:
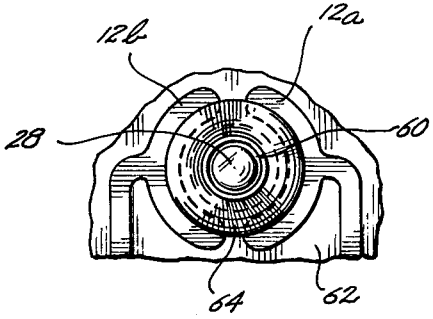
FIG. 6 is a plan view of the switch shown in FIG. 5.

In the modified embodiment shown in FIG. 5 the conductive post 60 mounted on base 62 instead of being tapered, is of stepped cylindrical exterior configuration. Instead of cooperating with a singular annular base contact it cooperates with a set of circular segmental contacts 12*a* and 12*b* on the adjacent face of the base panel 62. The step 60*a* in the diameter of cylindrical post 60 occurs at a distance above the plane of the contacts 12*a* and 12*b* materially less than the radius of the coils of contactor spring 64. Hence upon release of the pushbutton 66 the contractile force of the spring directed against the outer corner of step 60*a* resolves into force components including the necessary axial component to effect retraction of the spring from contacts 12*a* and 12*b*. If desired the outer portion of post 60, i.e., above the step, could be outwardly tapered so as to lengthen the return stroke of the spring contactor over which recoil force of the spring exists to urge the push-button outwardly.

Figure 1:
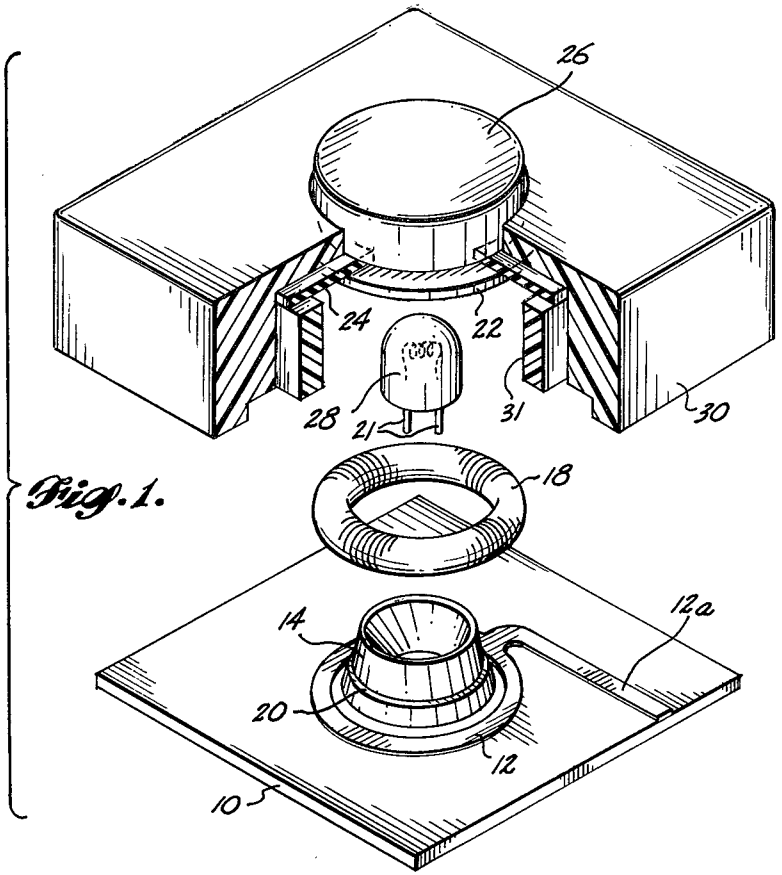
FIG. 1 is an exploded perspective view of the preferred embodiment of the switch of the present invention with built-in verification lamp adapted for use in computer system verification circuit switching.

In FIG. 5 the spring contactor 64, of toroidal configuration as in the preceding embodiment, is shown in its retracted position with the push-button 66 outwardly by the spring in the housing 68. Contactor spring 64 is also shown by broken lines in its switch-actuated position, wherein it bridges simultaneously between the conductive post 60 and both contact segments 12*a* and 12*b*. In this embodiment approximately half of the coils of the toroidal helical spring 64 come into play as parallel redundancy conduction paths in the switching and electrical chatter suppressing functions of the spring in accordance with the concept of this invention. Moreover, other things being equal, the electrical stead-state resistance of the switch in this case measured between each segmental contact 12*a* and 12*b* and the contact post 60 is slightly more than twice that of a switch of the design shown in FIG. 1 et seq wherein a single contact ring 12 extending fully around the contact post 14 cooperates with all coils of the contactor spring. Nevertheless even dividing the spring coils into groups associated with different base contacts, the switch has essentially the same advantageous characteristics as in the preferred embodiment. The contact post 60 has an external circuit terminal 61 projecting accessibly through the base panel as shown.

Figure 7:
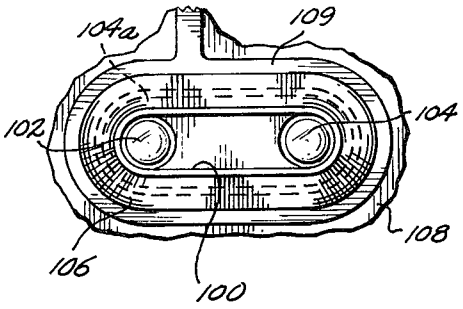
FIG. 7 is a plan view showing still another embodiment of the invention, in this instance with a post of elongated cross-section formed to accomodate two lamps such as may be associated with two separate verification circuits tested by the action of a single switch.

In the embodiment shown in FIG. 7 the hollow contact post 100 is of oval or elongated cross-sectional configuration, so as to accommodate two separate verification lights 102 and 104 within the enclosure afforded by the post. In this instance, therefore, the endless helical spring 106 stretched around the post assumes its configuration in order to cooperate with the post, its step or shoulder 104*a* and the associated one or more base contacts 109 involved. In other respects the device is or may be similar in nature and function to the structures shown in either FIG. 5 or FIG. 1, depending upon whether it is desired to employ a post having walls perpendicular to the base panel 108 (i.e., cylindrical) or of tapered configuration in the form of a modified truncated non-circular geometric form.

In any case, details of the illustrated embodiments of the invention are not intended to be delimiting insofar as concerns the scope of the invention viewed broadly, it being intended instead that the claims which follow be accorded a reasonably broad scope of interpretation in accordance with the contribution to the art thereby represented.

What is claimed is:

1. A snap-action electro-mechanical switch comprising a resiliently stretchable electrically conductive ring-like switch contactor, guide means movably supporting said contactor, said guide means comprising a post having a step thereon extending transversely of the post, said guide means maintaining said contactor under contractile tension looped around said post and in sliding contact therewith, actuator means engaging said contactor and operable to press the same longitudinally of the post against said step, and said contactor being complementally formed whereby force exerted by said actuator pressing the contactor against said step effects abrupt expansion of the contactor permitting it to pass over said step with a snap action, a first switch contact means disposed adjacent to the post in position to be engaged by said contactor substantially as it passes over the step, and second switch contact means on the post in position to be engaged by the contactor with the contactor engaging the first contact means, whereby said snap action of the contactor is attended by substantially simultaneous stable electrical bridging contact between said contact means.

2. The electromechanical switch defined in claim 1 wherein the ring-like member comprises an elongated multi-coil helical spring with ends joined together.

3. The electromechanical switch defined in claim 2 wherein the post is tapered in the direction away from said first contact means.

4. The electromechanical switch defined in claim 2 wherein the post is of substantially cylindrical configuration and the distance between the step and the first contact means is less than the radius of the spring coils.

5. The electromechanical switch defined in claim 1 further including a printed circuit panel with the first contact means comprising a flat conductive strip on one face of said panel at least partially encircling said post and with the post projecting transversely from said one face of said printed circuit panel adjacent said strip.

6. The electromechanical switch defined in claim 5 wherein the first contact means comprises a strip substantially completely encircling said post, and the second contact means comprises a surface on the post substantially completely encircling the same and slidably engageable by said contactor substantially throughout the encircling length thereof.

7. The electromechanical switch defined in claim 2 wherein the actuating means comprises an annular member surrounding the post and having push-button means thereon, said annular member bearing against said spring and by manual advancement of the push-button means being operable to advance the spring past the step and into engagement with the first contact means.

8. The electromechanical switch defined in claim 7 further including a housing surrounding the post and spring, said housing including annular sealing means therein comprising an elastomeric diaphragm surrounding and movably supporting the annular member and maintaining the same centered in relation to the post.

9. The electromechanical switch defined in claim 8 wherein the post is of hollow configuration, and an electrically energizeable light source mounted within said post.

10. The electromechanical switch defined in claim 1 wherein the post is tapered in the direction away from said first contact means.

11. The electromechanical switch defined in claim 1 wherein the post is of substantially cylindrical configuration and the distance between the step and the first contact means is less than the radius of the spring coils.

12. The electromechanical switch defined in claim 1 wherein the first contact means comprises a conductive member substantially completely encircling said post.

13. The electromechanical switch defined in claim 1 wherein the post is of hollow configuration, and an electrically energizeable light source mounted within said post.

14. The electromechanical switch defined in claim 1 wherein the first contact means comprises a strip substantially completely encircling said post, and the second contact means comprises a surface on the post substantially completely encircling the same and slidably engageable by said contactor substantially throughout the encircling length thereof.

* * * * *

Disclaimer 4,088,855.—*William Boyd Emery*, Kirkland, Wash. KEYBOARD ELECTRO-MECHANICAL SWITCH WITH COIL SPRING CONTACT. Patent dated May 9, 1978. Disclaimer filed July 27, 1978, by the assignee, *Korry Manufacturing Co.*

Hereby enters this disclaimer to claim 11 of said patent.

[*Official Gazette September 19, 1978.*]

UNITED STATES PATENT AND TRADEMARK OFFICE

CERTIFICATE OF CORRECTION

PATENT NO. : 4,088,855

DATED : May 9, 1978

INVENTOR(S) : William B. Emery

It is certified that error appears in the above-identified patent and that said Letters Patent are hereby corrected as shown below:

Column 1, line 65, delete "caused" and insert —causes—.
Column 3, line 34, delete "increase" and insert —increases—.
Column 4, line 9, delete "system" and insert —systems—.
Column 4, line 27, delete "pushbutton" and insert —push-button—.
Column 4, line 38, after "66" insert —forced—.
Column 4, line 48, delete "stead-state" and insert —steady-state—.
Column 5, line 25 (Claim 1), after "step," insert —said step—.
Abstract Page, delete "Andersson" and insert —Anderson—.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*